US012325981B2

(12) United States Patent
Lee

(10) Patent No.: US 12,325,981 B2
(45) Date of Patent: Jun. 10, 2025

(54) SYSTEM AND METHOD OF CONTROLLING CONSTRUCTION MACHINERY

(71) Applicant: HD HYUNDAI INFRACORE CO. LTD., Incheon (KR)

(72) Inventor: Cavin Lee, Yongin-si (KR)

(73) Assignee: HD HYUNDAI INFRACORE CO., LTD., Incheon (KR)

( * ) Notice: Subject to any disclaimer, the term of this patent is extended or adjusted under 35 U.S.C. 154(b) by 321 days.

(21) Appl. No.: 17/575,299

(22) Filed: Jan. 13, 2022

(65) Prior Publication Data

US 2022/0220707 A1 Jul. 14, 2022

(30) Foreign Application Priority Data

Jan. 14, 2021 (KR) ..... 10-2021-0005089

(51) Int. Cl.
*E02F 9/26* (2006.01)

(52) U.S. Cl.
CPC ..... *E02F 9/264* (2013.01); *E02F 9/261* (2013.01)

(58) Field of Classification Search
CPC ..... E02F 9/264; E02F 9/261
USPC ..... 348/148
See application file for complete search history.

(56) References Cited

U.S. PATENT DOCUMENTS 5,815,160 A * 9/1998 Kikuchi ..... G06T 11/60 345/661
10,067,915 B1 * 9/2018 Mishraky ..... G06F 16/9577
2006/0164441 A1 * 7/2006 Wada ..... G09G 5/14 345/660
2008/0084415 A1 * 4/2008 Gundel ..... G16H 30/40 345/427
2008/0176543 A1 * 7/2008 Gravel ..... H04L 67/04 455/414.2
2018/0121736 A1 * 5/2018 Tsunashima ..... H04N 23/00
2019/0093320 A1 * 3/2019 Forcash ..... E02F 9/261
2022/0186465 A1 * 6/2022 Otani ..... H04N 7/18

FOREIGN PATENT DOCUMENTS

WO WO-2020196838 A1 * 10/2020 ..... E02F 3/435

* cited by examiner

*Primary Examiner* — Richard A Hansell, Jr.
(74) *Attorney, Agent, or Firm* — Hauptman Ham, LLP

(57) ABSTRACT

A control system for construction machinery includes a camera installed in a work apparatus to photograph a working area in which the work apparatus works, an image processing device configured to recognize a shape of an attachment of the work apparatus in an image captured by the camera and perform a tracking image process on the image such that the attachment is displayed in a central region of the image, and a display device configured to display the tracking image-processed image.

11 Claims, 7 Drawing Sheets

SYSTEM AND METHOD OF CONTROLLING CONSTRUCTION MACHINERY

PRIORITY STATEMENT

This application claims priority under 35 U.S.C. § 119 to Korean Patent Application No. 10-2021-0005089, filed on Jan. 14, 2021 in the Korean Intellectual Property Office (KIPO), the contents of which are herein incorporated by reference in their entirety.

BACKGROUND

1. Field

Example embodiments relate to a control system and method for construction machinery. More particularly, example embodiments relate to a control system for providing an image of a working area in which construction machinery such as an excavator works, and a method of controlling the construction machinery using the same.

2. Description of the Related Art

When construction machinery such as an excavator performs excavation work such as deep excavation, trench work, pipe work, etc., an Around View Monitor system provides an image of the working area to an operator through a camera fixedly installed on a boom or an arm. However, the bucket is displayed at a position deviated from the center of the image due to a rotation angle of the boom or the arm during the operation, so that the operator's gaze moves along the bucket within the screen. Accordingly, since the visibility of the bucket is lowered, the operator may feel discomfort and workability and stability may be deteriorated.

SUMMARY

Example embodiments provide a control system for construction machinery capable of improving visibility of a working area.

Example embodiments provide a control method for construction machinery using the control system.

According to example embodiments, a control system for construction machinery includes a camera installed in a work apparatus to photograph a working area in which the work apparatus works, an image processing device configured to recognize a shape of an attachment of the work apparatus in an image captured by the camera and perform a tracking image process on the image such that the attachment is displayed in a central region of the image, and a display device configured to display the tracking image-processed image.

In example embodiments, the image processing device may include a shape recognizer configured to recognize the shape of the attachment in the image, and a tracking image processor configured to track a movement trajectory of the attachment to process the image so that the attachment is located in the central region.

In example embodiments, the shape recognizer may compare the actual image of the attachment in the image with a learning image of the attachment that is recognized and stored in advance by machine learning.

In example embodiments, the image processing device may further include a storage portion configured to store the learning image of the attachment by executing a deep learning algorithm using the actual image received from the shape recognizer as input data.

In example embodiments, the control system may further include an input portion configured to set a tracking image processing condition in the image processing device.

In example embodiments, the tracking image processing condition may include an area occupied by the central region of the entire display area of the display device and resolution thereof.

In example embodiments, the attachment may include a bucket.

In example embodiments, the camera may be installed on a boom to face the working area under the work apparatus.

In example embodiments, the entire display area of the display device may include a tracking display region in which the attachment is displayed to be tracked and an external region of the tracking display region.

According to example embodiments, in a method of controlling construction machinery, an image of a working area in which a work apparatus works is obtained from a camera installed in the work apparatus. A shape of the attachment of the work apparatus is recognized in the image to detect a position of the attachment. A tracking image process is performed on the image such that the attachment is displayed in a central region of the image. The tracking image-processed image is displayed through a display device.

In example embodiments, detecting the position of the attachment in the image may include comparing the actual image of the attachment in the image with a learning image of the attachment recognized and stored in advance by machine learning to determine the position of the attachment.

In example embodiments, the method may further include obtaining the learning image of the attachment by executing a deep learning algorithm using the actual image in the image as input data.

In example embodiments, the method may further include setting an image processing condition for tracking the position of the attachment.

In example embodiments, the image processing condition may include an area occupied by the central region of the entire display area of the display device and resolution thereof.

In example embodiments, the attachment may include a bucket.

According to example embodiments, a control system for construction machinery may recognize a shape of an attachment such as a bucket from an image captured by a camera installed in a work apparatus of the construction machinery and may track a movement trajectory of the bucket to perform a tracking image process such that the bucket is displayed in a central region on a screen of a display device.

Accordingly, since the bucket is displayed so as not to deviate from the fixed central region in the image taken of a working area even during excavation work such as trench work, an operator may perform the work while looking at the bucket while the operator's gaze is fixed during the work. Thus, visibility of the working area may be improved and stability may be secured.

However, the effect of the inventive concept may not be limited thereto, and may be expanded without being deviated from the concept and the scope of the present invention.

BRIEF DESCRIPTION OF THE DRAWINGS

Example embodiments will be more clearly understood from the following detailed description taken in conjunction with the accompanying drawings.

DETAILED DESCRIPTION OF EXAMPLE EMBODIMENTS

Figure 1:
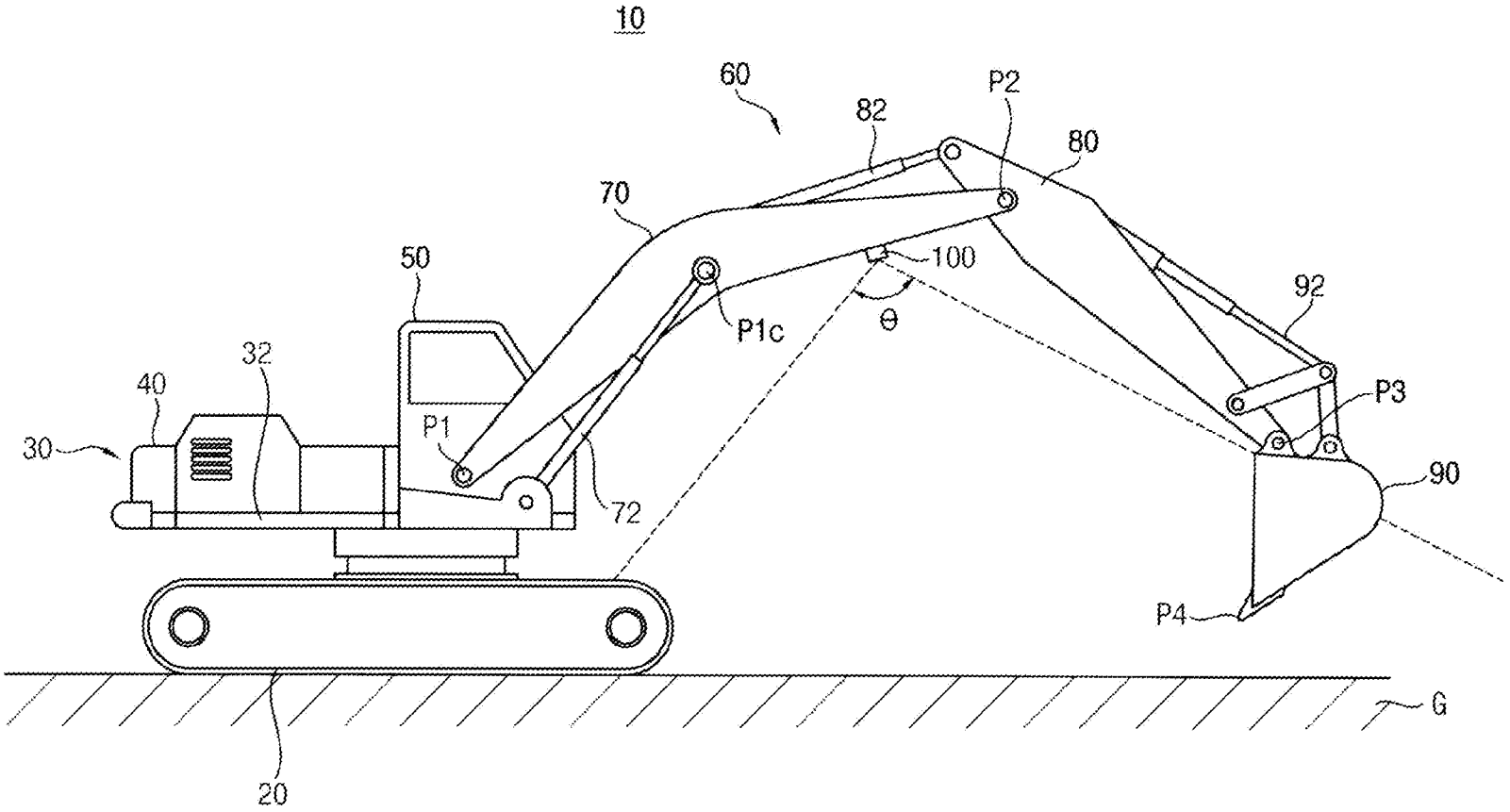
FIG. 1 is a side view illustrating construction machinery in accordance with example embodiments.

Hereinafter, preferable embodiments of the present invention will be explained in detail with reference to the accompanying drawings.

In the drawings, the sizes and relative sizes of components or elements may be exaggerated for clarity.

It will be understood that, although the terms first, second, third, etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of example embodiments.

The terminology used herein is for the purpose of describing particular example embodiments only and is not intended to be limiting of example embodiments. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which example embodiments belong. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Example embodiments may, however, be embodied in many different forms and should not be construed as limited to example embodiments set forth herein. Rather, these example embodiments are provided so that this disclosure will be thorough and complete, and will fully convey the scope of example embodiments to those skilled in the art.

Figure 2:
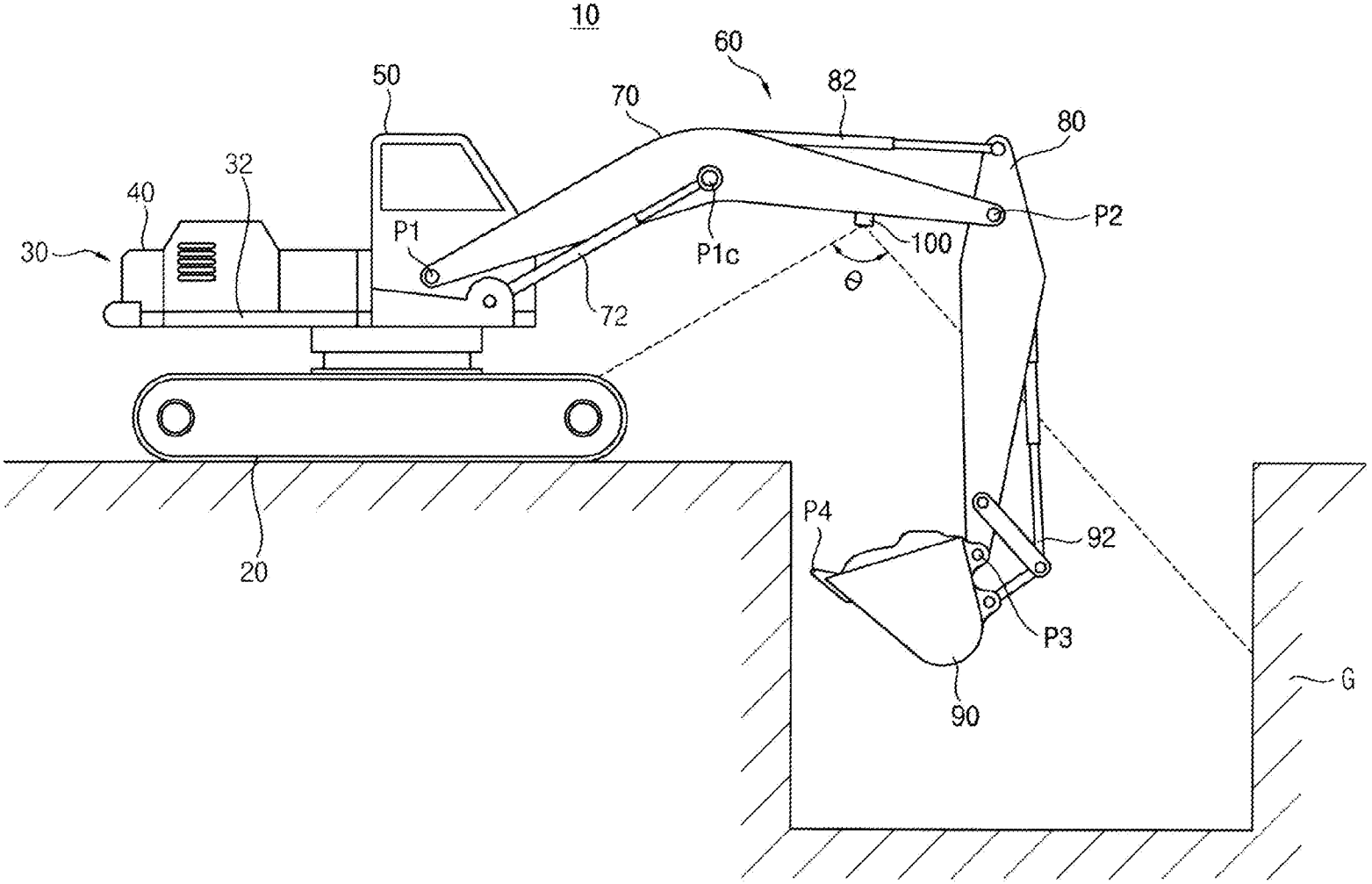
FIG. 2 is a side view illustrating trench work performed by the construction machinery of FIG. 1.
Figure 3:
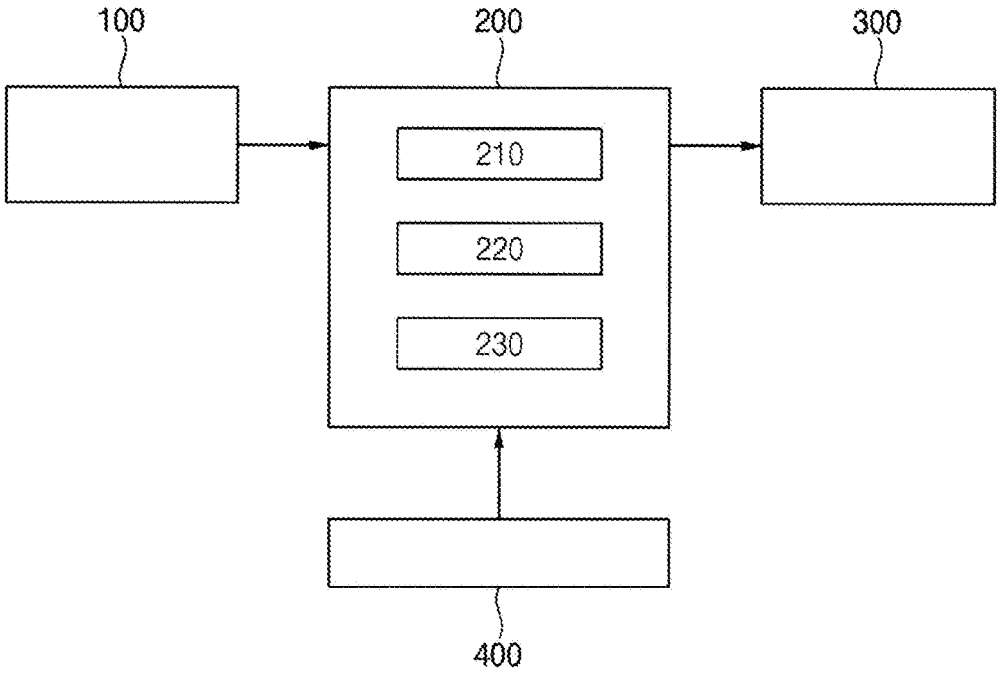
FIG. 3 is a block diagram illustrating a control system for the construction machinery in FIG. 1.

FIG. 1 is a side view illustrating construction machinery in accordance with example embodiments. FIG. 2 is a side view illustrating trench work performed by the construction machinery of FIG. 1. FIG. 3 is a block diagram illustrating a control system for the construction machinery in FIG. 1.

Referring to FIGS. 1 to 3, construction machinery 10 may include a lower travelling body 20, an upper swinging body 30 mounted to be capable of swinging on the lower travelling body 20, and a cabin 50 and a front work apparatus 60 installed in the upper swinging body 30.

The lower traveling body 20 may support the upper swinging body 30 and may travel the construction machinery 10 such as an excavator using power generated from an engine 110. The lower traveling body 20 may be a caterpillar type traveling body including a caterpillar track. Alternatively, the lower traveling body 20 may be a wheel type traveling body including traveling wheels. The upper swinging body 30 may have an upper frame 32 as a base, and may rotate on a plane parallel to the ground on the lower traveling body 20 to set a working direction.

The cabin 50 may be installed on a left front side of the upper frame 32, and the work apparatus 60 may be mounted on a front side of the upper frame 32. A counter weight 40 may be mounted at a rear of the upper frame 32, to stabilize the construction machinery by equilibrating an external force when the construction machinery performs the work of raising the load upward.

The front work apparatus 60 may include a boom 70, an arm 80 and a bucket 90. The front work apparatus 60 may be actuated by driving actuators such as a boom cylinder 72, an arm cylinder 82 and a bucket cylinder 92. In particular, the boom cylinder 72 for controlling a movement of the boom 70 may be installed between the boom 70 and the upper swinging body 30. The arm cylinder 82 for controlling a movement of the arm 80 may be installed between the arm 80 and the boom 70. The bucket cylinder 92 for controlling a movement of the bucket 90 may be installed between the bucket 90 and the arm 80. Additionally, a swing motor for controlling the upper swinging body 30 may be installed between the upper swinging body 30 and the lower travelling body 20. As the boom cylinder 72, the arm cylinder 82 and the bucket cylinder 92 expand or contract, the boom 70, the arm 80 and the bucket 90 may implement various movements, to thereby perform various works. Here, the boom cylinder 72, the arm cylinder 82 and the bucket cylinder 92 may be extended or contracted by a hydraulic oil supplied from a hydraulic pump.

Meanwhile, in addition to the bucket 90, various attachments may be attached to an end portion of the arm 80 according to the purpose of the work. For example, the bucket may be used for excavation or ground leveling, and a breaker (not illustrated) may be used to crush rocks or the like. In addition, a cutter may be used to cut scrap metal or the like.

In example embodiments, the construction machinery may include an excavator, a wheel loader, a forklift, etc. Hereinafter, it will be explained that example embodiments may be applied to the excavator. However, it may not be limited thereto, and it may be understood that example embodiments may be applied to other construction machinery such as the wheel loader, the forklift, etc.

Hereinafter, a control system for the construction machinery will be explained.

As illustrated in FIG. 3, a control system for construction machinery may include a camera 100 installed in the work apparatus 60 to photograph a working area in which the work apparatus 60 works, an image processing device 200 configured to perform a tracking image process such that the attachment is displayed in a central region of an image captured by the camera 100 an image from the camera portion 100, and a display device 300 configured to display the tracking image-processed image processed by the image processing device 200. Additionally, the control system for construction machinery may further include an input portion 400 configured to set an image processing condition in the image processing device 200.

The image processing device 200 such as a portion of an engine control unit ECU or a vehicle control unit VCU, or a separate control unit may be mounted in the upper swinging body 30. The image processing device 200 may be implemented with dedicated hardware, software, and circuitry configured to perform the functions described herein. These elements may be physically implemented by electronic circuits such as logic circuits, discrete components, microprocessors, hard-wired circuits, memory elements, wiring connections, and the like.

In example embodiments, the control system for construction machinery may include a plurality of AVM (Around View Monitor) cameras for an AVM system configured to capture and display the surrounding environment of the excavator 10. The camera 100 may include at least one of the plurality of AVM cameras. Although one camera is illustrated in FIGS. 1 and 2, it may not be limited thereto, and a plurality of cameras may be provided.

For example, the plurality of AVM cameras may include a first camera installed on an upper surface of the cab 50 to photograph the front region of the excavator, and a plurality of second cameras installed to be spaced apart around the upper frame 32 to photograph the surrounding region, and a plurality of third cameras installed in a rear surface of the upper frame 32 to photograph the rear region.

In example embodiments, the camera 100 may be installed on the boom 70 or the arm 80 of the work apparatus 60 to photograph the area in which the work apparatus 60 works. The camera 100 may be mounted on a lower surface of the boom 70 or the arm 80 to face the working area under the work apparatus 60. Alternatively, the camera 100 may be mounted on a side surface of the boom 70 or the arm 80 to face the working area.

The camera 100 may have a vertical viewing angle (Field of View, FoV) θ and a horizontal viewing angle based on the front direction of the excavator. For example, the vertical viewing angle may have an angular range of 60 degrees to 120 degrees.

The image captured by the camera 100 may be displayed through the display device 300, and an operator may perform the work while looking at an image of the bucket 90 displayed on a screen of the display device 300. However, since the camera 100 is fixedly installed on the boom 70 or the arm 80, as illustrated in FIGS. 1 and 2, the bucket 90 may be displayed at a position deviated from the central region of the entire screen in the image captured by the camera 100 according to a working angle when the work apparatus 60 performs the work, that is, a rotation angle of the boom 70 or the arm 80. Accordingly, since the operator's gaze moves along the bucket 90 within the screen during work, the operator may feel very uncomfortable because the visibility of the bucket 90 is deteriorated when viewing the image captured by the camera 100. As will be described later, the image processing device 200 may recognize a shape of the bucket 90 in the image captured by the camera 100 and may perform the tracking image process on the image to track the movement trajectory of the bucket 90 such that the bucket 90 is display in the central region (tracking display region) on the screen of the display device 300.

In example embodiments, the image processing device 200 may include a shape recognizer 210, a tracking image processor 220, and a storage portion 230. The image processing device 200 may be installed in the form of a control device embedded in the control device or the display device of the construction machinery.

In particular, the shape recognizer 210 may recognize the shape of the attachment (i.e., the bucket 90) of the work apparatus 60 in the image captured by the camera 100 to determine a position where the attachment is displayed. The shape recognizer 210 may compare the actual image of the attachment in the image with a learning image of the attachment previously recognized and stored by machine learning to recognize the shape of the attachment.

The attachment in the image obtained from the camera 100 may be displayed as corresponding pixels among a plurality of pixels. Here, the working space photographed by the camera 100 may be expressed as grids of the same size, and the presence or absence of an object may be displayed in each grid.

The shape recognizer 210 may compare the actual image in the image with the learning image of the attachment stored in the storage portion 230, and if the actual image and the stored image of the attachment are the same, it may be recognized as the attachment. Here, the learning image of the attachment may include images stored by machine learning various shapes of the attachment (e.g., the bucket 90) photographed by the camera 100.

The storage portion 230 may store the machine-learned images that obtained by machine learning using the actual images of the image received from the camera 100 as input data. Here, machine learning may be a field of artificial intelligence and may refer to an algorithm that enables a processing device such as a computer to learn.

The machine learning may include supervised learning including decision tree, K-nearest neighbor (KNN), neural network, support vector machine (SVM), etc., unsupervised learning such as lustering, reinforcement learning including deep learning, convolutional neural networks (CNN), etc.

The shape recognizer 210 may determine the position of the attachment by identifying pixel positions (start point and end point) on the camera screen where the attachment is located.

The tracking image processor 220 may track the movement trajectory of the attachment to process the image so that the attachment is displayed to be located in the central region (tracking display region) of the image. For example, a relative distance from the pixel position of the attachment in the image captured by the camera 100 to the central region may be calculated, and the relative distance may be reflected to move the attachment to the central region.

Additionally, the tracking image processor 220 may adjust a size of the attachment according to a preset tracking processing condition to match the resolution of the display device 300, to thereby resolve a visual distortion caused by the size difference due to the movement trajectory of the attachment. The tracking image processor 220 may process the image so as to be displayed as an actual image and output the tracking-processed image to the display device 300. The functions of the tracking image processor 220 may be implemented through a single processor such as GP or CPU for image processing, or through computational processing of separate processors.

In example embodiments, an image processing condition in the image processor 220 may be set through the input portion 400. For example, the image processing condition may include a location, a size, resolution, etc. of the central region (tracking display region) of the entire display area of the display device 300. The size, location, resolution, etc. of the tracking processing region may be fixedly set by a manufacturer according to a type of equipment, and may be freely changed and set by the operator or maintenance personnel.

For example, the input portion 400 may be implemented in a form of an instrument panel option, and the operator may change the condition for the tracking processing region, the resolution, etc. through the input portion 400.

The display device 300 may display an image by dividing the image captured by the camera portion into a tracking display region R in which the attachment is displayed to be tracked and an external region of the tracking display region R. The display device 300 may additionally display an outline of the tracking display region R such that the tracking display region R can be distinguished, or may not display the outline of the tracking display region R and may display the tracking-processed image to be connected to an image of the external region of the tracking display region R.

Hereinafter, a method of controlling construction machinery using the control system for the construction machinery in FIG. 3 will be explained.

Figure 4:
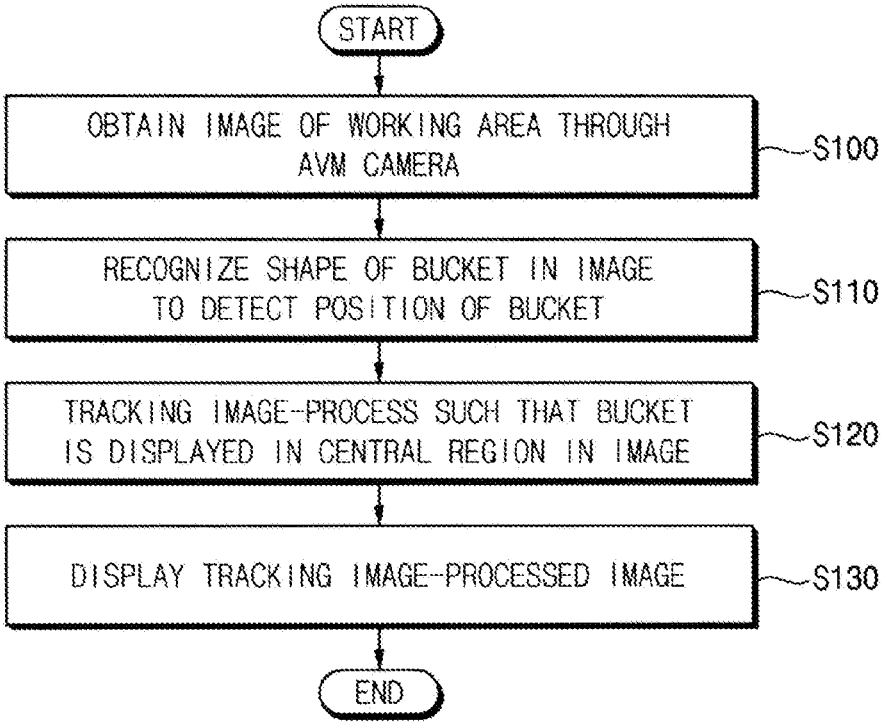
FIG. 4 is a flow chart illustrating a control method for construction machinery in accordance with example embodiments.
Figure 5:
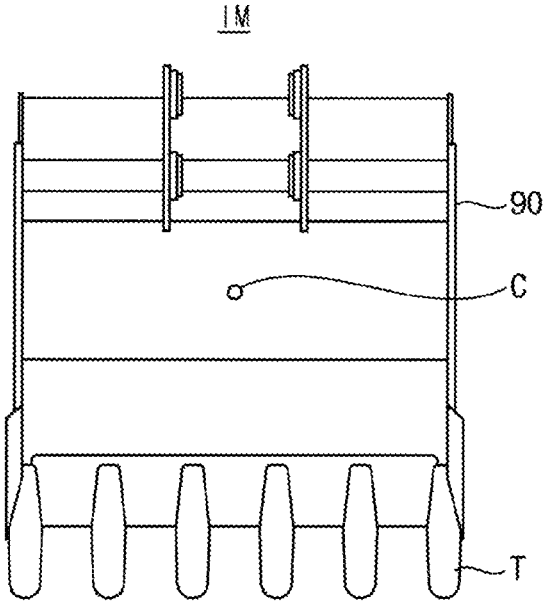
FIG. 5 is a view illustrating a bucket in an image captured by the camera of FIG. 3.
Figure 6A:
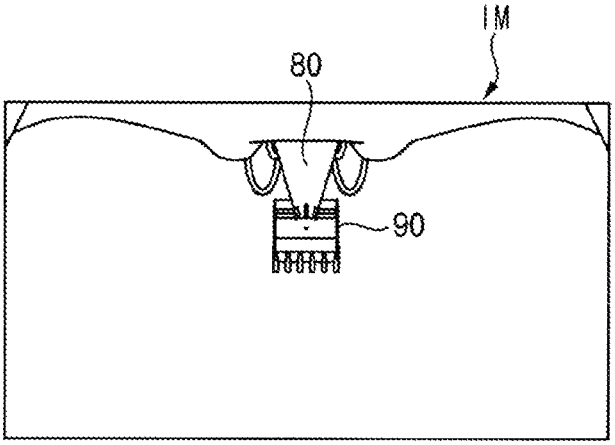
FIG. 6A is a view illustrating an image captured by the camera during an arm dump and boom down operation.
Figure 6B:
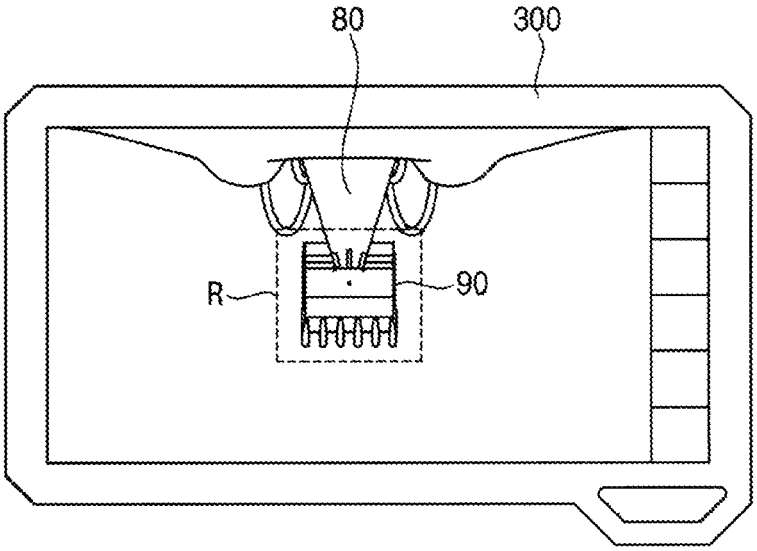
FIG. 6B is a view illustrating a screen on which the image of FIG. 6A is tracking image-processed and displayed on a display device.
Figure 7A:
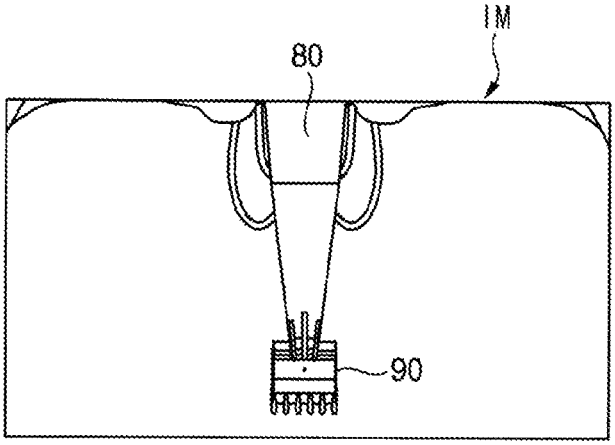
FIG. 7A is a view illustrating an image captured by the camera during an arm crowd and boom up operation.
Figure 7B:
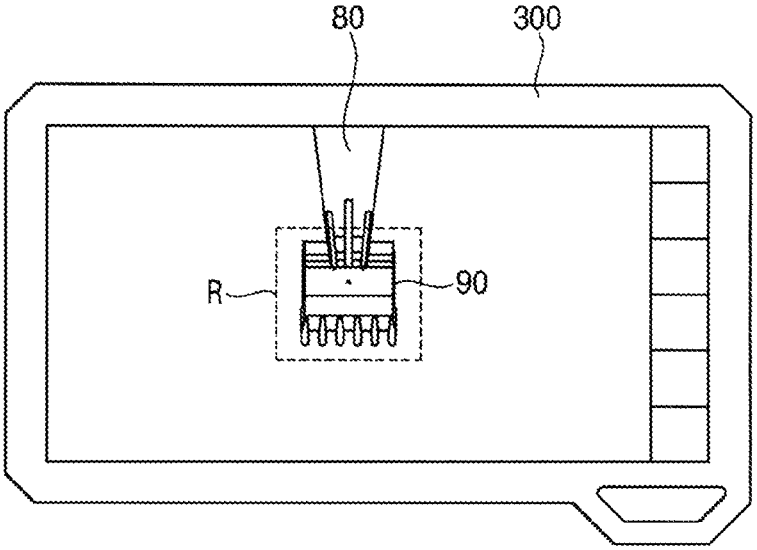
FIG. 7B is a view illustrating a screen on which the image of FIG. 7A is tracking image-processed and displayed on a display device.

FIG. 4 is a flow chart illustrating a control method for construction machinery in accordance with example embodiments. FIG. 5 is a view illustrating a bucket in an image captured by the camera of FIG. 3. FIG. 6A is a view illustrating an image captured by the camera during an arm dump and boom down operation, and FIG. 6B is a view illustrating a screen on which the image of FIG. 6A is tracking image-processed and displayed on a display device. FIG. 7A is a view illustrating an image captured by the camera during an arm crowd and boom up operation, and FIG. 7B is a view illustrating a screen on which the image of FIG. 7A is tracking image-processed and displayed on a display device.

Referring to FIGS. 1 to 7B, first, an image IM captured by a camera 100 installed in a work apparatus 60 of construction machinery 10 may be obtained (S100).

In example embodiments, the camera 100 may include at least one of a plurality of AVM cameras. The camera 100 may be installed on a boom 70 or an arm 80 of the work apparatus 60 to obtain the image IM of a working area in which the work apparatus 60 works. The camera 100 may be installed on a lower surface of the boom 70 or the arm 80 to face the working area under the work apparatus 60. Alternatively, the camera 100 may be installed on a side surface of the boom 70 or the arm 80 to face the working area.

Then, a shape of the bucket 90 in the image (IM) may be recognized to detect a position of the bucket 90 (S110), and tracking image processing may be performed so that the bucket 90 is displayed in a central region of the image (S120). Then, the tracking image-processed image may be displayed on a display device 300 (S130).

In example embodiments, the image processing device 200 may recognize the shape of the bucket 90 from the image IM to determine the position of the bucket 90. For example, the actual image of the bucket 90 in the image (IM) may be compared with a learning image of the bucket previously recognized and stored by machine learning to determine the position of the bucket.

As illustrated in FIG. 5, the bucket 90 in the image obtained from the camera 100 may be displayed as corresponding pixels among a plurality of pixels. Here, the working space photographed by the camera 100 may be expressed as grids of the same size, and the presence or absence of an object may be displayed in each grid.

The actual image in the image IM may be compared with the learning image of the bucket stored in advance, and if the actual image and the stored image of the bucket are the same, it may be recognized as the bucket. Here, the learning image of the bucket may include images stored by machine learning various shapes of the bucket (e.g., the bucket 90) photographed by the camera 100. Here, machine learning may be a field of artificial intelligence and may refer to an algorithm that enables a processing device such as a computer to learn.

Then, pixel positions (start point and end point) on the camera screen where the bucket is positioned may be grasped to determine the position of the bucket, and then, the image IM may be tracking image-processed such that the bucket is displayed to be positioned in the central region (tracking display region) R of the image. For example, a relative distance from the pixel position of the bucket in the image IM captured by the camera 100 to the central region may be calculated, and the relative distance may be reflected to move a display position of the bucket to the central region.

Then, the tracking image-processed image may be image-processed so as to be displayed as an actual image, and may be outputted to the display device 300.

As illustrated in FIG. 6A, the position of the bucket 90 may be determined by recognizing the shape of the bucket 90 from the image IM obtained from the camera 100 during an arm dump and boom down operation. At this time, the bucket 90 may be located at the top, not the central region of the image. As illustrated in FIG. 6B, the image IM may be tracking image-processed such that the bucket 90 is displayed in the central region (tracking display region R) of the display device 300.

As illustrated in FIG. 7A, the position of the bucket 90 may be determined by recognizing the shape of the bucket 90 from the image IM obtained from the camera 100 during an arm crowd and boom up operation. At this time, the bucket 90 may be located at the bottom, not the central region of the image. As illustrated in FIG. 7B, the image IM may be tracking image-processed such that the bucket 90 is displayed in the central region (tracking display region R) of the display device 300.

In this case, a size of the bucket may be adjusted according to a preset tracking processing condition to match the resolution of the display device 300, to thereby resolve a visual distortion caused by the size difference due to the movement trajectory of the bucket. For example, the size (area) and resolution of the tracking display region R and the size of the bucket 90 in FIG. 6B are substantially the same as the size (area) and resolution of the tracking display region R and the size of the bucket 90 in FIG. 7B.

In example embodiments, an image processing condition for tracking the image may be set. The image processing condition in the image processing apparatus 200 may be set through the input portion 400. For example, the image processing condition may include an area occupied by the central region (tracking display region) among the entire display area of the display device 30, the resolution of the image, etc. The tracking display region may be selected according to the type of equipment.

As mentioned above, the shape of the attachment such as the bucket 90 may be recognized in the image captured by the camera 100 installed in the work apparatus 60 of the construction machinery 10, and the tracking image process where the movement trajectory of the bucket 90 is tracked may be performed to display the bucket 90 in the central region (tracking display region) R on the screen of the display device 300.

Accordingly, even during excavation work such as trench work, the bucket 90 may be displayed so as not to deviate from the fixed central region area, in the image taken of the working area. Thus, visibility of the working area may be improved and stability may be secured.

The foregoing is illustrative of example embodiments and is not to be construed as limiting thereof. Although a few example embodiments have been described, those skilled in the art will readily appreciate that many modifications are possible in example embodiments without materially departing from the novel teachings and advantages of the present invention. Accordingly, all such modifications are intended to be included within the scope of example embodiments as defined in the claims.

What is claimed is:

1. A control system for construction machinery, the control system comprising:

a camera installed in a work apparatus to photograph a working area in which the work apparatus works;

an image processing device configured to recognize a shape of an attachment of the work apparatus in an image captured by the camera and perform a tracking image process on the image such that the attachment is displayed in a central region of the image; and a display device configured to display the tracking image-processed image, wherein during the tracking image process, the image processing device is further configured to calculate a relative distance from a pixel position of the attachment of the work apparatus in the image to the central region, and to move a display position of the attachment of the work apparatus to the central region based on the relative distance, wherein the image processing device is further configured to adjust a size of the attachment in the image according to a preset tracking image processing condition to match a resolution of the display device, to thereby resolve a visual distortion caused by a size difference due to a movement trajectory of the attachment, and wherein the image processing device includes:

a shape recognizer configured to compare the actual image of the attachment in the image with a learning image of the attachment that is recognized and stored in advance by machine learning, and a storage portion configured to store the learning image of the attachment by executing a deep learning algorithm using the actual image received from the shape recognizer as input data.

2. The control system of claim 1, wherein the image processing device further includes:

a tracking image processor configured to track a movement trajectory of the attachment to process the image so that the attachment is located in the central region, and wherein the shape recognizer is configured to recognize the shape of the attachment in the image.

3. The control system of claim 1, further comprising:

an input portion configured to set a tracking image processing condition in the image processing device.

4. The control system of claim 3, wherein the tracking image processing condition includes an area occupied by the central region of the entire display area of the display device and resolution thereof.

5. The control system of claim 1, wherein the attachment includes a bucket.

6. The control system of claim 1, wherein the camera is installed on a boom to face the working area under the work apparatus.

7. The control system of claim 1, wherein the entire display area of the display device includes a tracking display region in which the attachment is displayed to be tracked and an external region of the tracking display region.

8. A method of controlling construction machinery, the method comprising:

obtaining an image of a working area in which a work apparatus works, from a camera installed in the work apparatus;

recognizing a shape of the attachment of the work apparatus in the image to detect a position of the attachment;

performing a tracking image process on the image such that the attachment is displayed in a central region of the image; and displaying the tracking image-processed image through a display device, wherein the tracking image process is performed by calculating a relative distance from a pixel position of the attachment of the work apparatus in the image to the central region, and moving a display position of the attachment of the work apparatus to the central region based on the relative distance, wherein the tracking image process is performed by adjusting a size of the attachment in the image according to a preset tracking image processing condition to match a resolution of the display device, to thereby resolve a visual distortion caused by a size difference due to a movement trajectory of the attachment, wherein detecting the position of the attachment in the image comprises comparing the actual image of the attachment in the image with a learning image of the attachment recognized and stored in advance by machine learning to determine the position of the attachment, and wherein the method further comprises:

obtaining the learning image of the attachment by executing a deep learning algorithm using the actual image in the image as input data.

9. The method of claim 8, further comprising:

setting a tracking image processing condition for tracking the position of the attachment.

10. The method of claim 9, wherein the tracking image processing condition includes an area occupied by the central region of the entire display area of the display device and resolution thereof.

11. The method of claim 8, wherein the attachment includes a bucket.

* * * * *